US009931759B2

(12) United States Patent
Smithwick, Jr. et al.

(10) Patent No.: US 9,931,759 B2
(45) Date of Patent: Apr. 3, 2018

(54) ROTARY CUTTING DIE FOR CUTTING CORRUGATED BOARD HAVING PRODUCT EJECTORS CONFIGURED TO SEPARATE DIE CUT PRODUCT WITHOUT CRUSHING FLUTES IN THE CORRUGATED BOARD

(71) Applicant: Container Graphics Corporation, Cary, NC (US)

(72) Inventors: James M Smithwick, Jr., New Bern, NC (US); Rodney Lee Garmon, Lawrenceville, GA (US)

(73) Assignee: Container Graphics Corporation, Cary, NC (US)

( * ) Notice: Subject to any disclaimer, the term of this patent is extended or adjusted under 35 U.S.C. 154(b) by 28 days.

(21) Appl. No.: 15/196,911

(22) Filed: Jun. 29, 2016

(65) Prior Publication Data

US 2018/0001504 A1 Jan. 4, 2018

(51) Int. Cl.
*B26F 1/38* (2006.01)
*B26D 7/01* (2006.01)

(52) U.S. Cl.
CPC ..... *B26F 1/384* (2013.01); *B26D 7/01* (2013.01)

(58) Field of Classification Search
CPC ..... B26D 7/01; B26F 1/384; B26F 1/44
USPC ..... 83/117, 118–120
See application file for complete search history.

(56) References Cited

U.S. PATENT DOCUMENTS 3,919,924 A * 11/1975 Snodgrass ..... B31B 50/00 493/405
5,546,839 A * 8/1996 Gardiner ..... B26D 5/12 83/123
6,071,225 A * 6/2000 Kucharski ..... B31B 50/00 493/396
8,201,482 B2 * 6/2012 Vossen ..... B26D 7/025 76/107.8
8,663,081 B2 * 3/2014 Gordon ..... B31B 1/25 493/107

* cited by examiner

*Primary Examiner* — Omar Flores Sanchez
(74) *Attorney, Agent, or Firm* — Coats & Bennett PLLC

(57) ABSTRACT

A rotary cutting die for cutting corrugated board to form a die cut product including one or more product ejectors that are specifically configured to avoid crushing the flutes of the die cut product.

28 Claims, 7 Drawing Sheets

ROTARY CUTTING DIE FOR CUTTING CORRUGATED BOARD HAVING PRODUCT EJECTORS CONFIGURED TO SEPARATE DIE CUT PRODUCT WITHOUT CRUSHING FLUTES IN THE CORRUGATED BOARD

FIELD OF THE INVENTION

The present invention relates to rotary cutting dies specifically designed to cut and score corrugated board that is used in making corrugated board boxes.

BACKGROUND

Rotary cutting dies are used to cut and score sheets of corrugated board to produce die cut products that can be manipulated into boxes. Rotary cutting dies typically include a curved die board that is configured to mount on a die cylinder. When used, the die cylinder and die board are mounted adjacent an anvil and a nip is defined between the cylinder and the anvil. Sheets of corrugated board are fed into and through the nip and, in the process, the sheet of corrugated board is cut and scored to form the die cut product. Die boards commonly include product and scrap cutting blades, scoring rules, trim and scrap strippers and product ejectors for separating the die cut product from the cutting die.

A common problem with rotary cutting dies that operate on corrugated board is that of controlling the pressure exerted against the corrugated board by the product ejectors. If the pressure is too great, the die cut product is damaged. That is, if the pressure is too great, the corrugated flutes are crushed. This makes the resulting boxes weaker and hence the boxes possess less stacking strength and the crushed flutes have a negative impact on the appearance of the product. The appearance of the product is especially important if the corrugated board is printed.

On the other hand, if the ejection force exerted by the product ejectors is too low, then this will impact the separation of the die cut product from the cutting die during the die cutting operation. That is, if the force is insufficient to dislodge or remove the cut die product from the cutting die, it follows that the product will continue with the cutting die and the die cutting operation will be seriously impacted.

The problem is applying sufficient pressure to the die cut product to separate it from the cutting die but at the same time limiting the pressure to a pressure that will not crush the flutes of the die cut product. There are tried and proven materials for product ejectors that have been used in the past. Generally in the past, pressure constraints were not as important as they are today as the corrugated board could withstand relatively high pressures without the flutes crushing. However, there is a trend in the industry of employing corrugated board having flutes that are more easily crushed. Therefore, there is now a need for a product ejector that will efficiently separate die cut product but lend themselves to controlling and limiting pressures that will not crush flutes in the die cut product.

SUMMARY OF THE INVENTION

The present invention relates to a product ejector for ejecting die cut product from a rotary cutting die. Various configurations for the product ejector are shown and discussed. To control and limit the pressure exerted by the product ejector against the die cut product and to reduce or eliminate flute crushing, the product ejectors are configured in ways that limit the amount of pressure generated internally during compression and at the same time provide a relatively large product engaging area that enables internal forces to be spread over a relatively large area.

In particular, the product ejector includes a relatively narrow column of compressible material and an outer engaging surface for contacting the die cut product. The outer engaging surface is generally cantilevered from the column and thus includes a larger surface area than the minimum cross-sectional area of the column. Hence, forces generated in the column of the product ejector due to compression are transmitted to the engaging surface. This enables forces to be generally uniformly applied across the area of the engaging surface and also enables the forces applied by the engaging surface to be controlled so as to not crush the flutes of the die cut product.

In one embodiment, the product ejector includes an inner portion, an intermediate portion, and an outer portion. The inner portion is secured to the die board or to a structure associated with the die board. The outer portion includes the engaging surface. The intermediate portion lies between the engaging surface and an end of the inner portion and includes a relatively small cross-sectional area compared to the area of the larger engaging surface. This is achieved by providing voids or cutouts in the sides of the product ejector.

Another feature of the present invention is a design that effectively pre-loads the product ejector. In one embodiment, a relief area is provided in the engaging surface and which is aligned with the column. This tends to cause the forces generated in the column to initially be transferred to the cantilevered portions extending from the column as opposed to a disproportionate amount of the force being applied to an area of the engaging surface aligned with the column. After some amount of compression takes place, the relief area blends into the engaging surface to form a more continuous and uninterrupted surface for engaging the die cut product. This may tend to provide a more uniform distribution of forces to the die cut product being engaged by the product ejector.

Other objects and advantages of the present invention will become apparent and obvious from a study of the following description and the accompanying drawings which are merely illustrative of such invention.

DESCRIPTION OF EXEMPLARY EMBODIMENTS

Figure 1:
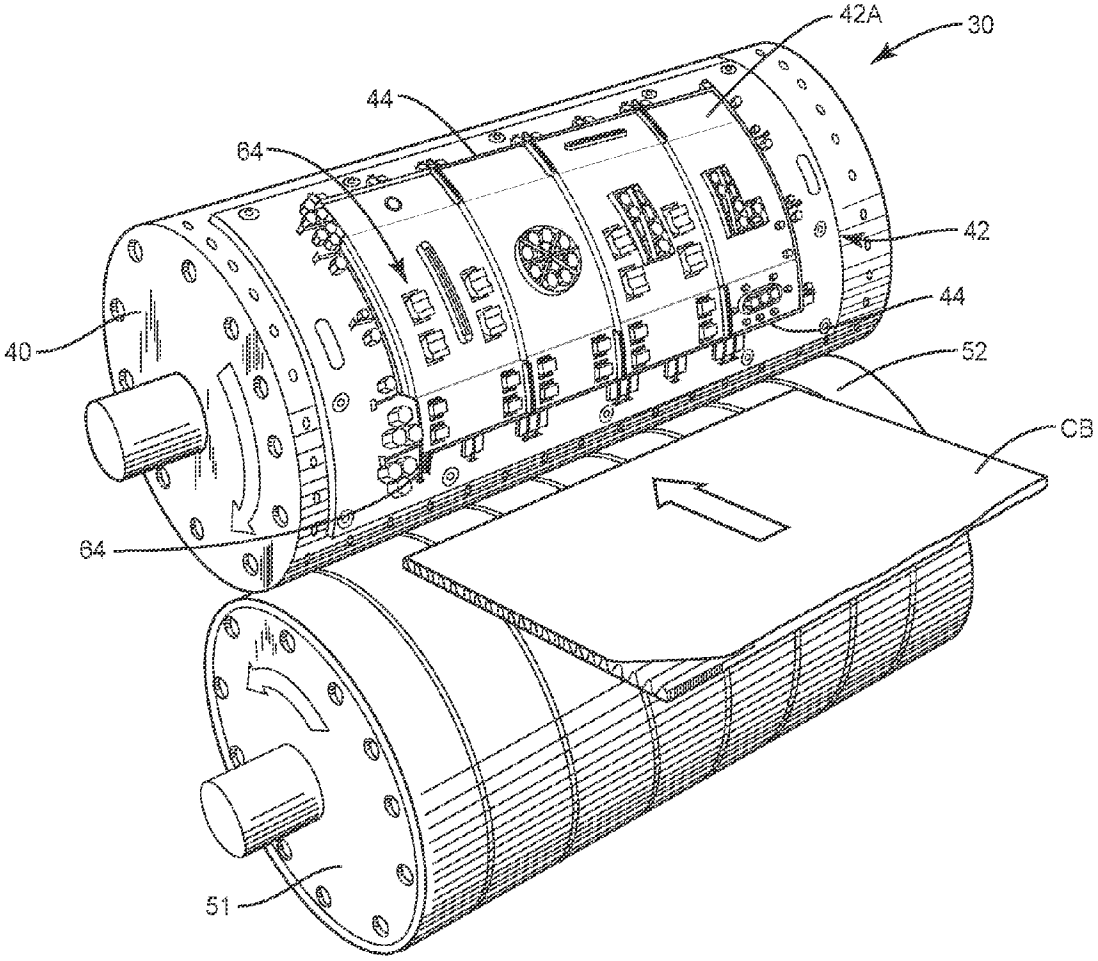
FIG. 1 is a perspective view of a rotary die cutting machine including a rotary cutting die mounted on a die cylinder and an anvil disposed adjacent the die cylinder.

With reference to FIG. 1, there is shown therein a rotary cutting die apparatus indicated generally by the numeral 30. The rotary cutting die apparatus includes a die board indicated generally by the numeral 42. Die board 42 includes an outer surface 42A and an inner surface 42B. See FIG. 4. Die board 42 is adapted to be mounted to a die board cylinder 40 that is rotatively mounted adjacent an anvil cylinder 51 having an outer sheath 52. For completeness subsequently herein components of the die board 42 will be discussed.

Initially, however, the discussion is directed at the design of the product ejectors, indicated generally by the numeral 64, which are mounted to the die board (or to an attaching structure associated with the die board) and function to separate the die cut product DCP from the die board 42. See FIG. 4. Product ejectors 64 are strategically placed on the die board 42 to engage and efficiently separate the die cut product from the die board.

Product ejectors 64 are constructed of resilient and compressible material, for example a rubber-like material that is actually a man-made elastomer with closed or hybrid cells, and are designed to be compressed as the die cut product DCP passes through the nip defined between the die cylinder 40 and the anvil surface. See FIG. 4, for example. As the die cut product DCP exits the nip, the product ejectors 64 expand or extend while engaging the die cut product and efficiently strip the die cut product from product cutting blades 44 secured on the die board 42.

Shown in the drawings are a number of different embodiments for the product ejector 64 of the present invention. All of the embodiments share common design features that will now be discussed.

With reference to FIGS. 2-11B, each product ejector 64 includes three portions, an inner portion indicated generally by the numeral 66, an intermediate portion indicated generally by the numeral 68, and an outer portion indicated generally by the numeral 70. Inner portion 66 includes an inner end 66A. The inner end 66A or the inner portion 66 is designed to be secured to the die board 42 or to an attaching structure associated with the die board. As seen in the drawings, the outer portion 70 is disposed on the opposite end portion of the product ejector 64. Outer portion 70 includes an engaging surface or outer end that is referred to by 70A. It is this engaging surface 70A that engages the die cut product DCP passing through the nip and which applies an outer directed force that causes the die cut product to be separated from the die board 42. Intermediate portion 68 lies between the engaging surface 70A and the inner end 66A. In a preferred embodiment, the intermediate portion 68 encompasses the center of the product ejector 64.

Generally the intermediate portion 68 includes a smaller cross-sectional area than the outer portion 70. In cases where the "cross-sectional area of the intermediate portion" is used, this means the minimum cross-sectional area defined by the concaved sides 76. In this same regard, the engaging surface 70A includes a larger surface area than the minimum cross-sectional area of the intermediate portion 68. Expressed differently, the cross-sectional area of the product ejector 64 generally increases from the intermediate portion 68 towards the engaging surface 70A. This increase can be progressive, linear, or non-linear. As discussed below in more detail, this enables better control over the pressure exerted by the product ejector 64 against the die cut product DCP as the die cut product passes through the nip. Below it is noted that a relief area 72A is formed in the product ejector 64. Relief area 72A forms a part of the engaging surface 70A. Thus as used herein, the engaging surface 70A includes the surface area attributable to the relief area 72A.

Figure 2:
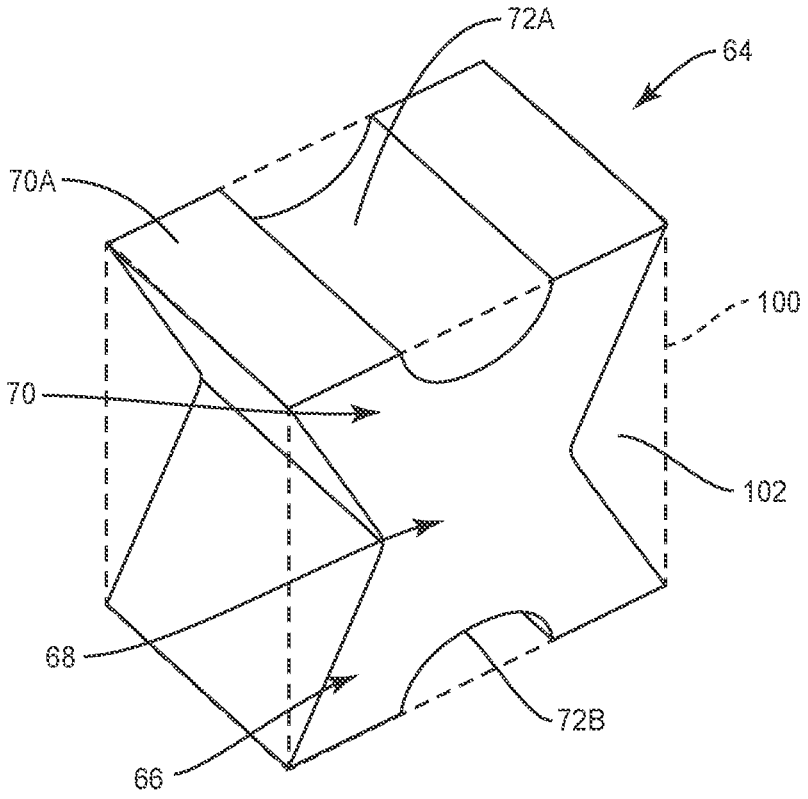
FIG. 2 is a perspective view of one embodiment of a product ejector shown within the confines of a reference block.

As shown in the drawings, generally the opposite sides 76 of the product ejector 64 are indented. This forms a generally concave shape about the sides or the sidewall structure 76, depending on the general form of the product ejector 64. This is particularly illustrated in FIG. 2. FIG. 2 shows a reference column in dotted lines which is indicated by the numeral 100. Reference column 100 encompasses the entire product ejector 64. Note the voided or cutout areas 102 that form the indented or concave areas adjacent the opposite sides 76 of the product ejector 64. As will be discussed later, the voided or cutout areas can assume various shapes. See the embodiments shown in FIGS. 2-11.

The cutouts or voided areas 102, along with the general configuration of the product ejector 64, form a column 104 that extends through a portion of the product ejector 64. To illustrate, column 104 is bounded by reference lines 106 and 108. See FIGS. 5B-11B. In a preferred embodiment, the column 104 extends generally centrally through the product ejector 64. Product ejector 64 includes a central axis 110. Axis 110 extends generally centrally through the column 104. In some parts of the specification, the column 104 may be referred to as a "relatively narrow column". This means that the column includes a relatively narrow width or cross-sectional area relative to the maximum width or the maximum overall width of the engaging surface 70A. This results in at least a portion of the outer portion 70 extending in cantilevered fashion from the outer portions of the column 104.

Generally the inner portion 66 also extends laterally from the column 104. As will be discussed below, this provides significant surface area for attaching the product ejector 64 to the die board 42 or to a fastening structure associated with the die board. Thus, as the drawings reflect in some embodiments, the overall width of the product ejector 64 increases from the intermediate portion 68 to the inner end 66A.

There is also provided in a preferred embodiment one or more relief areas in or on the product ejector 64. It is preferable that these relief areas be provided on the exterior surfaces of the product ejector 64 but internal relief areas can also be provided. As seen in the drawings, there is a relief area 72A formed across the engaging surface 70A. Relief area 72A is formed by a curved channel that extends transversely across the engaging surface 70A. Note in the drawings that relief area 72A is aligned with column 104. As will be discussed subsequently herein, relief area 72A preloads the product ejector 64 as it moves through the nip and engages the die cut product. In some embodiments, as noted above, additional relief areas can be provided. It may be desirable to provide a relief area 72B across the inner end 66A of the product ejector 64.

Shapes and general configuration of the product ejector 64 can vary. In the above discussion, the inner portion 66, intermediate portion 68 and outer portion 70, as well as the engaging surface 70A and inner end 66A, have been described. FIGS. 4-11 show various configurations of the product ejector 64. In addition to the engaging surface 70A, the relief area 72A, the inner end 66A, and the relief area 72B, each product ejector includes front and back sides 74 and sides 76.

It may be beneficial to briefly review the various alternative configurations. In FIGS. 1-5B, the product ejector 64 assumes a generally X-shaped configuration. Note that the sides 76 taper towards the axis 110 and the intermediate portion 68. This forms the cutouts or concave-shaped areas 102 along the sides 76. Relief areas 72A and 72B are aligned with the column 104. Portions of the engaging surface 70A cantilever over the concaved areas 102.

Figure 6A:
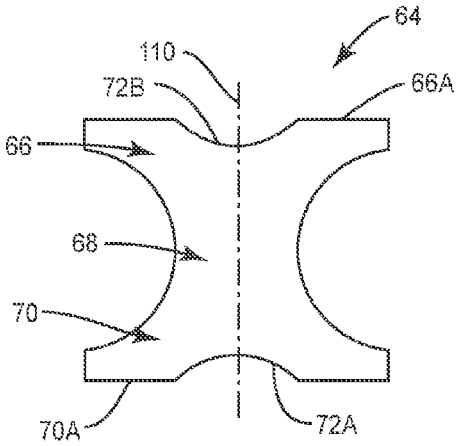
FIG. 6A shows another embodiment for the product ejector.
Figure 6B:
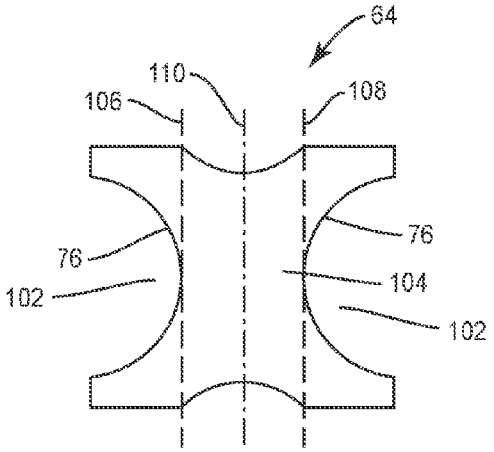
FIG. 6B is similar to FIG. 6A but shows a column formed in the product ejector.

In FIGS. 6A and 6B, the product ejector 64 assumes a generally I-shaped configuration. The sides 76 are curved or arcuate-shaped and form the concave areas 102. Column 104 defined by reference lines 106 and 108 aligns with the relief areas 72A and 72B. Portions of the engaging surface 70A cantilever over the concaved areas 102. End 66A forms a substantial surface for attachment to the die board 42 or a structure associated with the die board.

Figure 7A:
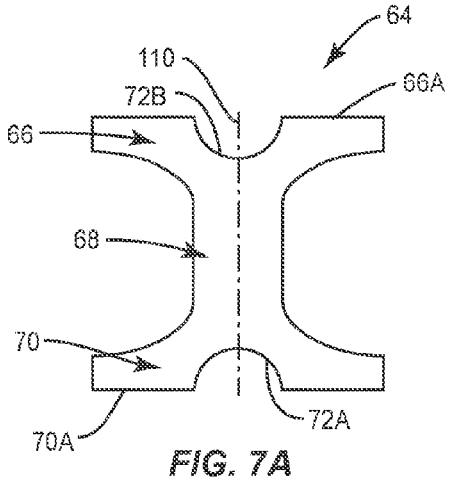
FIG. 7A is a view illustrating another embodiment for the product ejector.
Figure 7B:
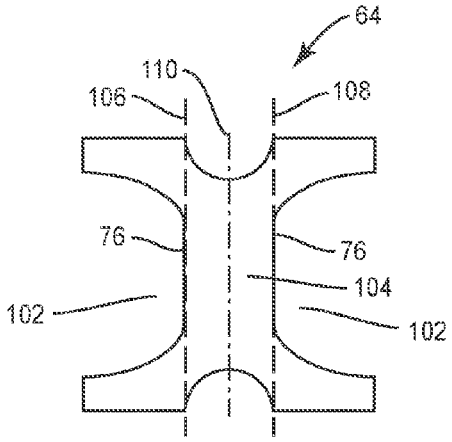
FIG. 7B is a view of the product ejector shown in FIG. 7A but showing the column formed in the product ejector.

FIGS. 7A and 7B are another generally I-shaped configuration for the product ejector 64. It is similar in many respects to the product ejector shown in FIGS. 6A and 6B. However, in the FIGS. 7A and 7B embodiments, the sides 76 are both curved and linear but together define concave areas 102. Like other product ejectors described, the design of the embodiment shown in FIGS. 7A and 7B includes a column 104 that extends vertically through the product ejector and is defined by reference lines 106 and 108.

Figure 8A:
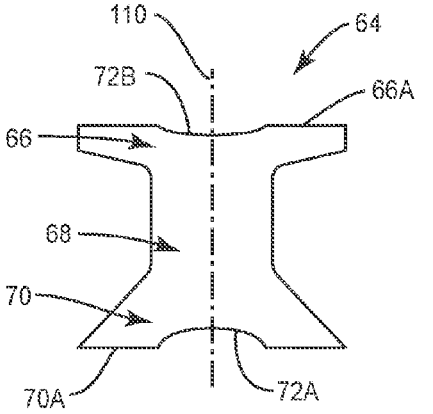
FIG. 8A is another view of an alternative embodiment for the product ejector.
Figure 8B:
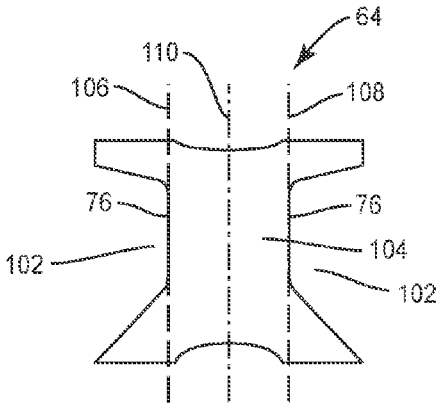
FIG. 8B shows the same product ejector shown in FIG. 8A but shows the column formed in the product ejector.
Figure 9A:
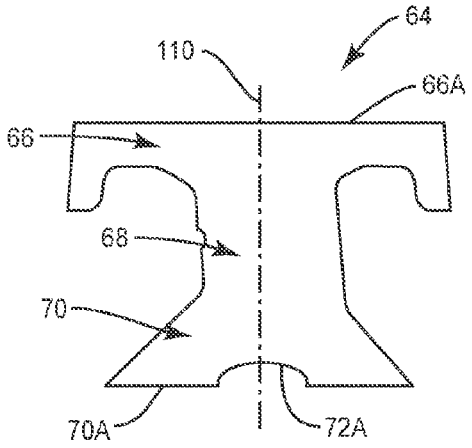
FIG. 9A shows another embodiment for the product ejector.
Figure 9B:
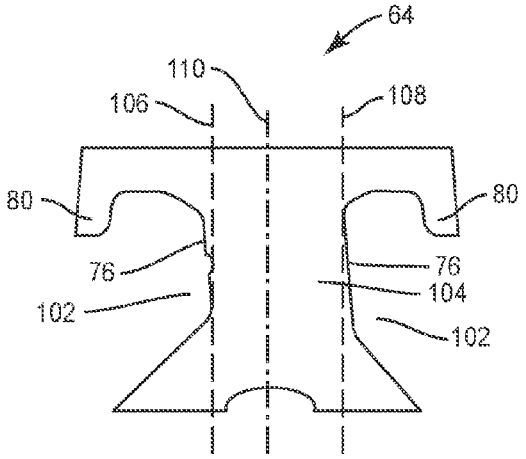
FIG. 9B shows the same product ejector shown in FIG. 9A but shows the column formed in the product ejector.

In the embodiments shown in FIGS. 8A and 8B, the sides 76 are linear and multi-directional. Column 104 is aligned with axis 110, as well as relief areas 72A and 72B. In the case of this embodiment, the relief areas 72A and 72B are more shallow than some of the relief areas. In the embodiment of FIGS. 9A and 9B, the sides 76 are both curved and linear. The inner portion 66 of the product ejector forms a pair of opposed glue tabs 80. As described in a patent application entitled "Rotary Cutting Die for Cutting Corrulgated Board and Including a Product Ejector with Integral Glue Tabs" filed concurrently herewith, the glue tabs 80 are designed to be secured to the wall of an opening formed in the die board 42. The disclosure of this application is expressly incorporated herein by reference. Again, as with other embodiments, the column 104 aligns with axis 110, as well as relief area 72A.

Figure 10A:
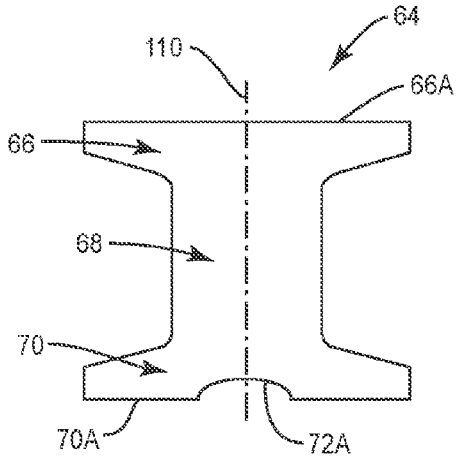
FIG. 10A shows yet another alternative embodiment for the product ejector.
Figure 10B:
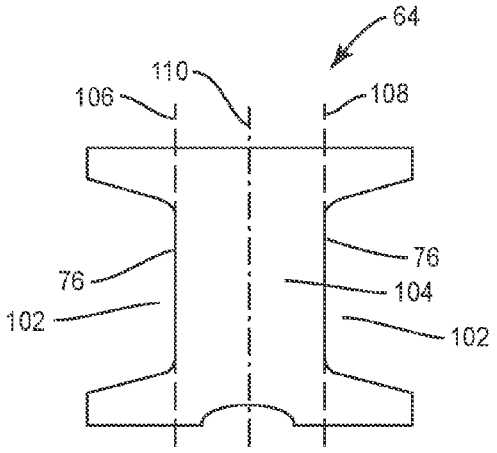
FIG. 10B shows the same product ejector shown in FIG. 10A but illustrates the position of the column in the product ejector.

The embodiment shown in FIGS. 10A and 10B is another generally I-shaped configuration for the product ejector 64. Sides 76 are channel-shaped in this case. Portions of the engaging surface 70A cantilever over the concave areas 102. Again, the end 66A forms a substantial surface for gluing the product ejector to the die board 42 or to a structure associated with the die board. As with the other embodiments, column 104 aligns axis 110, as well as relief area 72A.

Figure 11A:
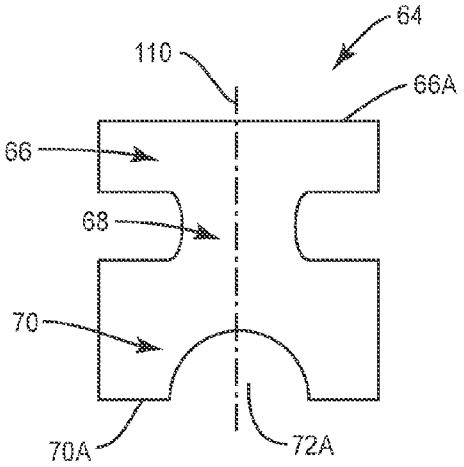
FIG. 11A shows another alternative configuration for the product ejector.
Figure 11B:
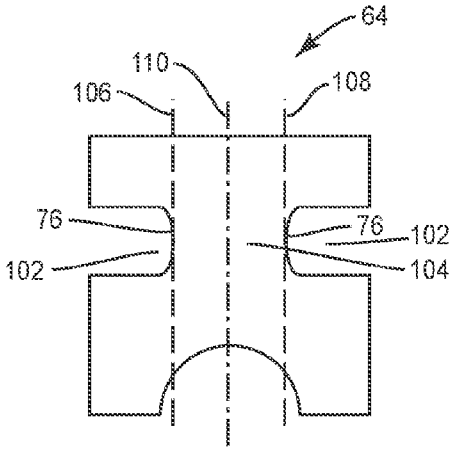
FIG. 11B shows the same product ejector shown in FIG. 11A but also illustrates the column formed in the product ejector.

FIGS. 11A and 11B show another alternative embodiment for the product ejector 64. In this case, the concave areas 102 are defined by a generally U-shaped segment in the sides 76. Thus, the opposed sides 76 as illustrated in FIG. 11B are both arcuate or curve-shaped as well as linear. In this case, there is only one relief area 72A which is formed in the engaging surface 70A. Compared to some of the relief areas in other embodiments, the relief area 72A is fairly substantial. As with other designs, the product ejector 64 shown in FIGS. 11 A and 11B includes a vertical column 104 of compressible material that is defined by the reference lines 106 and 108.

Figure 4:
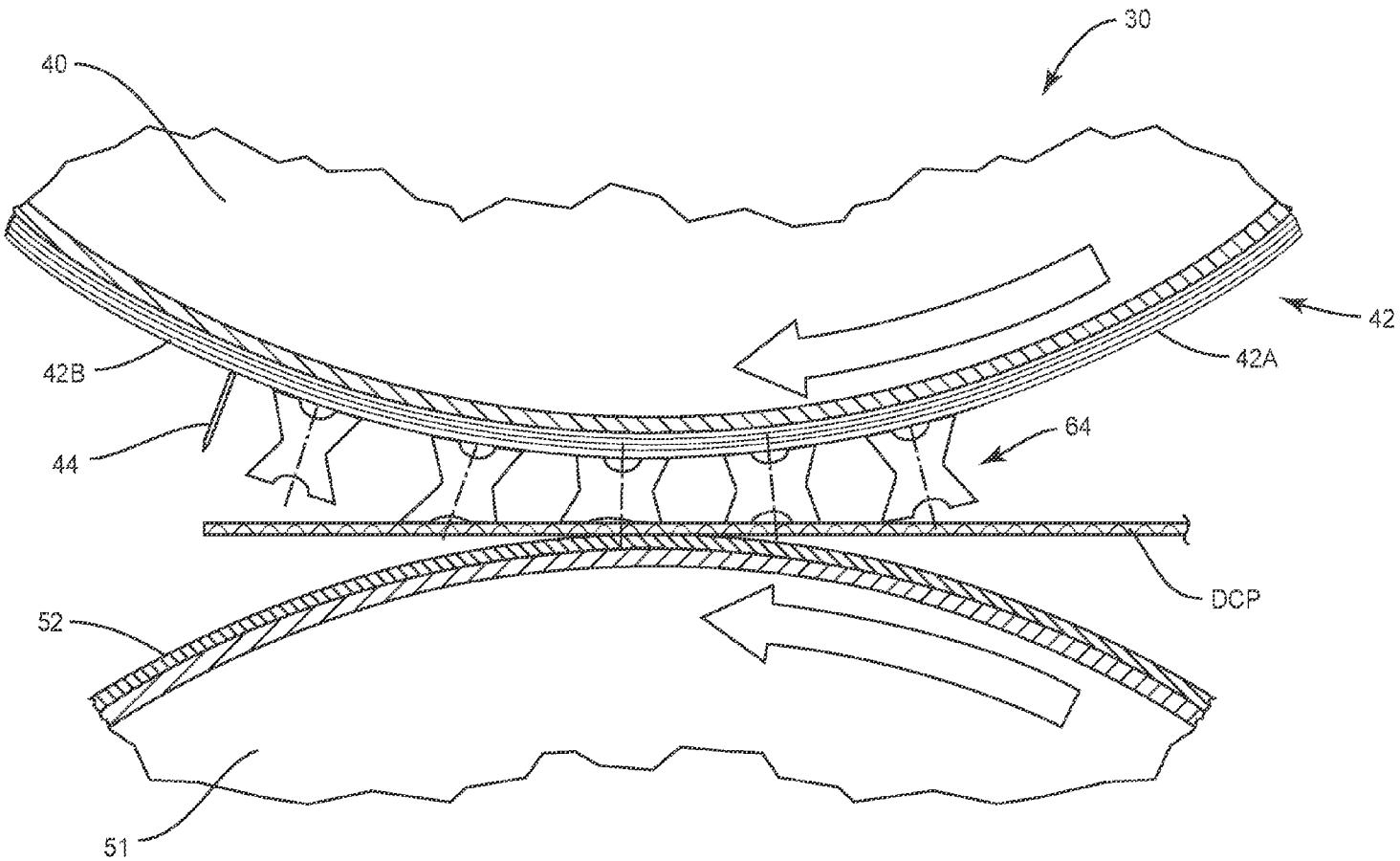
FIG. 4 is a cross-sectional view of the rotary cutting die showing a series of product ejectors engaging a die cut product passing through the nip of the rotary cutting die machine.
Figure 5A:
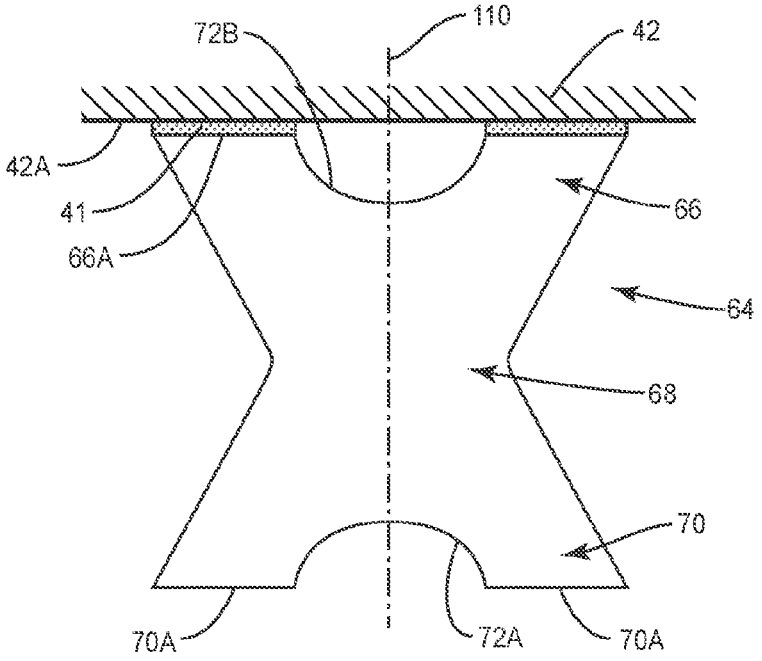
FIG. 5A shows one embodiment of the product ejector secured to a portion of the die board.
Figure 5B:
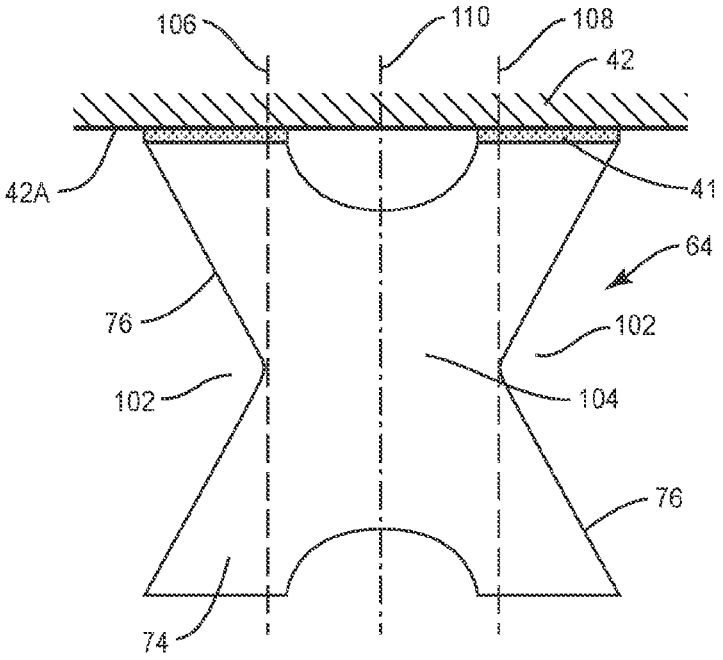
FIG. 5B is a view similar to FIG. 5A but showing a column formed in the product ejector.

With reference to FIG. 4, a series of product ejectors 64 are secured to the die board 42 and project downwardly therefrom. The orientation of the product ejectors can vary. For example, the product ejectors 64 shown in FIG. 4 could be rotated 90° such that they extend transversely related to the direction of rotation of the die board 42. Die board 42 is rotated clockwise while the anvil 51 is rotated counterclockwise. Corrugated board is fed into the nip. At various points in and around the nip, product cutting blades, such as blade 44, engages the corrugated board and cuts the corrugated board to form the die cut product DCP or a portion of a die cut product. As seen in FIG. 4, the product ejectors 64 are disposed between the die board 42 and the die cut product DCP. As the product ejectors 64 enter the nip, they are compressed between the die board 42 and the die cut product DCP. In one example, the product ejectors are compressed between 40-60% depending on the elastomer material. Over-compressing the product ejector 64 can result in exceeding the desification point in which case the product ejector will fail. The problem, as discussed before, lies in applying and controlling the force exerted by the product ejectors on the die cut product DCP. It is important that the pressure exerted be sufficient to efficiently separate the die cut product DCP from the die board 42. However, it is desirable that the pressure applied by the product ejector 64 not be so great as to crush the corrugated flutes of the die cut product DCP. Flutes in some corrugated board manufactured today will not withstand the relatively high pressures that were sometimes employed by corrugated board die cutting machines in the past. As a general rule, it is desirable, in the case of some corrugated board, to control the pressure exerted by the product ejectors 64 in a pressure range of 18-40 psi.

The configuration and design of the product ejector 64 described above and shown in the drawings enables better pressure control while still efficiently separating the die cut product from the die board 42. As the product ejectors 64 are compressed, forces are generated in the compressible material. That is, in response to the product ejector 64 being compressed, an internal force is generated and this force is applied to the die cut product via the outer engaging surfaces 70A which also includes the compressed relief area 72A. The forces tend to push the die cut product against the anvil 51 as the product ejectors pass through the nip. Significant forces are generated in the column 104. These forces are generally transmitted from the column 104 through the outer portion 70 of the product ejector 64 to the engaging surface 70A. If compared with conventional cubical and parallelepiped configured product ejectors, one appreciates that the design of the sides 76 and the cutout or concaved areas 102 effectively reduces the compressible material and renders the product ejector 64 as a whole softer. This in itself reduces the pressure exerted by the product ejector compared to a conventional cubical or parallelpiped designs. A further reduction in pressure is achieved by designing the intermediate portion 68 such that generally this part of the product ejector has smaller cross-sectional areas than the outer portion 70 or the engaging surface 70A. Thus, the internal forces generated in the product ejector are further reduced at the engaging surface 70A. This is because the internal generated forces are spread over a larger area and hence the pressure or psi is reduced per unit area. With these configurations shown in the drawings, it is possible to use conventional elastomer material such as a rubber-like material that is actually a man-made elastomer with closed or hybrid cells and by specifically configuring the overall design of the product ejector, pressure can be reduced and controlled at a level that does not substantially crush flutes of the die cut product DCP. As discussed above, in many cases it is desirable to reduce the pressure down to a range of 18-40 psi in order to avoid crushing the flutes.

Another feature incorporated into the product ejector 64 design is a pre-loading feature. This is achieved by providing relief areas in the product ejector 64. Note, for example, relief area 72A formed in the engaging surface 70A. Relief area 72A is aligned with column 104. If the relief area 70A was not present, there may be a tendency during compression to concentrate the force directly underneath the column 104. This may be undesirable because these concentrated forces may exceed the targeted pressure range and may cause localized flute crushing. By providing the relief area 72A, it follows that as the product ejector starts to compress, the internal forces generated are transmitted first to the cantilevered areas that lie outside of the relief area 72A. This effectively pre-loads these areas. As the compression continues, a point is reached where the cantilevered areas and the pressure relief area 72A form a surface that is generally level or even. Thus, at this point, any further compression results in a generally uniform pressure applied across the area of the engaging surface 70A to the die cut product DCP.

Figure 3:
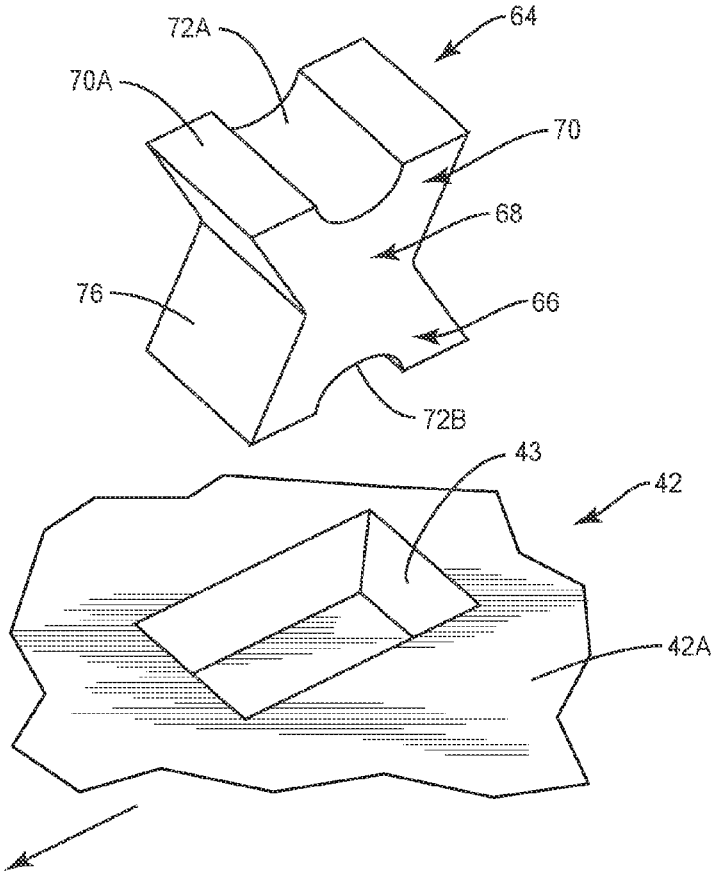
FIG. 3 is an exploded view showing a die board and one embodiment of the product ejector.
Figure 3A:
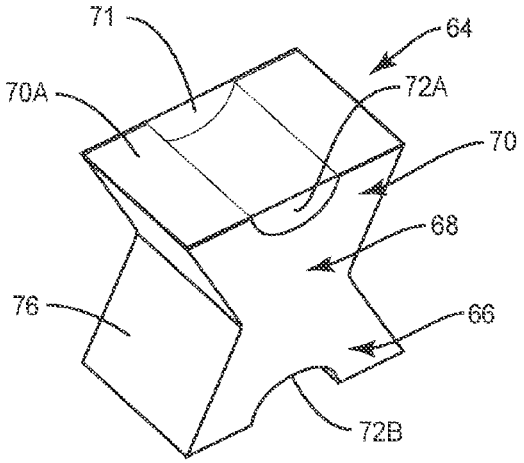
FIG. 3A is a perspective view of an alternative design for the product ejector where the product ejector includes a reinforcing member secured to an end portion of the product ejector.

In some cases, it may be desirable to reinforce the product ejector 64. One approach is shown in FIG. 3A. As seen in the FIG. 3A embodiment, a relatively thin reinforcing member 71 is secured by adhesive or other suitable means across the outer end 70A of the product ejector 64. Various materials can be used for the reinforcing member 71. For example, the reinforcing member 71 may be constructed of mylar, plastic, fabric or other suitable materials. In one example, the reinforcing member 71 can be mylar having a thickness of approximately 0.010 to 0.030 inches. Reinforcing member 71 can be applied to all of the exemplary product ejectors 64 described herein and shown in the drawings. In the case of the FIG. 3A embodiment, note that the reinforcing member 71 spans the relief area 72A and effectively ties together the surfaces on the opposite sides of the relief area 72A. It should be pointed out, however, that the reinforcing member 71 can be applied to an end or other portion of the product ejector without regard to the shape of the particular surface receiving the reinforcing member 71.

There are various ways to attach the product ejector 64 directly or indirectly to the die board 42. One example is that the product ejector 64 can be glued via end 66A directly to the surface 42A of the die board 42. See FIGS. 5A and 5B. In this case, a glue layer or an adhesive layer 41 is used to secure the end 66A to the outer surface 42A of the die board. Another approach is illustrated in FIG. 3. Here an opening 43 is provided in the die board. Some product ejectors 64 can be designed to be glued to the sidewall of the opening 43. For example, the design shown in FIGS. 9A and 9B include glue tabs 80 that can be glued directly to the surrounding wall of the opening 43. In other cases, the opening 43 may not extend completely through the die board 42 and would include a bottom. In these cases, the product ejector 64 can be glued or otherwise secured to the bottom of the opening 43. The bottom can be positioned at various depths in the die board 42. Another example employs a substrate secured to the inner surface 42B of the die board and stretched over an opening 43 that extends completely through the die board 42. In this case, the end 66A of the product ejector 64 can be secured directly to the substrate underlying the opening in the die board. One particular example of this approach includes a relatively thin adhesive tape that is secured to the inner surface 42B of the die board and stretched over the opening 43. The end 66A can be inserted into the opening and adhered to the adhesive side of the tape that faces towards the outer surface 42A.

Now that the product ejector 64 has been discussed, it may be beneficial to briefly review the basic structure and function of the rotary cutting die apparatus shown in FIG. 1. This will give a more complete and unified understanding of how corrugated board is cut and/or scored and some context with respect to the function of the product ejectors 64. With particular reference to FIG. 1, the rotary cutting die apparatus 30 includes the die board cylinder 40 and the anvil cylinder 51. Die board cylinder 40 is designed to receive and hold the curved die board 42. Die board cylinder 40 and the die board 42 are disposed with respect to the anvil cylinder 51 such that the nip is defined between the die board and the anvil. As sheets of corrugated board CB are fed through the nip, the corrugated board is engaged by the die board 42 which trims, cuts and scores the corrugated board. Anvil cylinder 51 is typically surrounded by the sheath 52 which is a relatively durable material such as urethane, which provides a backing surface. As such, the anvil cylinder 51 rotates in a manner that is generally synchronous with the adjacent die board cylinder 40 during normal operations.

Die board 42 is typically constructed of laminated plywood. Die boards, such as that illustrated in FIG. 1, typically include a combination of cutting blades, scoring rules, resilient scrap strippers and product ejectors. With reference to FIG. 1, a typical die board 42 is shown therein. Die board 42, as noted above, is curved to fit the die cylinder 40. Die board 42 includes an outer surface 42A that is exposed, as viewed in FIG. 1, and an inner surface 42B which lies adjacent and in contact with the die cylinder 40.

In the exemplary die board 42 shown in FIG. 1, the die board has mounted thereto a series of cutting blades 44. The cutting blades 44 extend around the die board 42. Blades 44 function to cut the overall dimensions of a die cut product which can be manipulated to form a box. Thus, as seen in FIG. 1, a sheet of corrugated board CB is fed into the nip and as the corrugated board moves through the nip, the blades 44 will cut and form the die cut product.

Also, a typical die board, such as that shown in FIG. 1, includes scrap cutting blades and strippers to strip scrap from the scrap cutting blades. For example, scrap cutting blades can be used to cut holes, slots and openings in the die cut product. Therefore, it is appreciated that the scrap cutting blades and scrap strippers are typically disposed within the confines of blades 44.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A rotary cutting die adapted to be mounted on a rotary die cylinder for cutting corrugated board fed into a nip defined between the die cylinder and the surface of the anvil to produce a die cut product, the rotary cutting die comprising:

a curved die board configured to be mounted to the cylinder and including inner and outer surfaces;

one or more cutting blades mounted on the die board for cutting the corrugated board fed through the nip to produce the die cut product;

one or more product ejectors associated with the die board for engaging a portion of the die cut product passing through the nip and exerting a force on the die cut product which assists in separating the die cut product from the cutting die;

each product ejector comprising compressible material and including an inner portion, an intermediate portion and an outer portion which includes an engaging surface for engaging the die cut product passing through the nip;

wherein the intermediate portion of the product ejector is narrower than the outer portion of the product ejector and wherein the engaging surface includes a larger area than the cross-sectional area of the intermediate portion of the product ejector such that forces generated by the product ejector are distributed over the larger area of the engaging surface of the product ejector; and wherein the product ejector includes opposed sides and wherein the opposed sides are indented adjacent the intermediate portion of the product ejector such that portions of the outer portion of the product ejector are cantilevered over the indented sides.

2. The rotary cutting die of claim 1 wherein the inner portion of the product ejector includes a cross-sectional area that is larger than the cross-sectional area of the intermediate portion of the product ejector.

3. The rotary cutting die of claim 1 wherein the product ejector includes a center and wherein the product ejector includes at least one relief area formed in the product ejector and spaced from the center of the product ejector and wherein the relief area is aligned with and spaced from the center.

4. The rotary cutting die of claim 3 wherein the relief area is formed in the engaging surface of the product ejector.

5. The rotary cutting die of claim 1 wherein the product ejector includes two relief areas, one formed in the engaging surface and the other formed in an end of the inner portion of the product ejector and wherein both relief areas are disposed at opposite ends of a column formed in the product ejector where the width of the column is defined, in part at least, by the intermediate portion of the product ejector.

6. The rotary cutting die of claim 1 wherein the product ejector assumes a generally X-shaped configuration.

7. The rotary cutting die of claim 6 wherein the X-shaped configuration forms opposed sides that converge towards the intermediate portion of the product ejector.

8. The rotary cutting die of claim 1 wherein there is provided cutouts formed adjacent the opposed sides of the product ejector and wherein there is formed a continuous column of compressible material that extends through the intermediate portion of the product ejector.

9. The rotary cutting die of claim 1 wherein the inner portion of the product ejector includes one or more glue tabs for securing the product ejector to the die board.

10. The rotary cutting die of claim 1 including a reinforcing member secured to the engaging surface of the product ejector.

11. The rotary cutting die of claim 1 including a reinforcing member secured to the engaging surface of the product ejector and wherein the reinforcing member is relatively thin as the reinforcing member includes a thickness of approximately 0.010 to approximately 0.030 inches.

12. The rotary cutting die of claim 1 wherein a relief area in the form of a depression is formed in the engaging surface of the product ejector and wherein a reinforcing member extends over the depression and is secured to areas of the engaging surface opposite the depression.

13. The rotary cutting die of claim 1 including a reinforcing member secured to the engaging surface of the product ejector and wherein the reinforcing member is constructed of mylar, plastic, or fabric and includes a thickness of approximately 0.010 to 0.030 inches.

14. A rotary cutting die adapted to be mounted on a rotary die cylinder for cutting corrugated board fed into a nip defined between the die cylinder and the surface of the anvil to produce a die cut product, the rotary cutting die comprising:

a curved die board configured to be mounted to the cylinder and including inner and outer surfaces;

one or more cutting blades mounted on the die board for cutting the corrugated board fed through the nip to produce the die cut product;

one or more product ejectors disposed on the die board for engaging a portion of the die cut product passing through the nip and exerting a force on the die cut product which assists in separating the die cut product from the cutting die;

the product ejector comprising compressible material and including an inner end and an outer engaging surface for engaging the die cut product passing through the nip;

the product ejector including opposed sides that are indented between the inner end and the outer engaging surface to form a relatively narrow column where portions of the outer engaging surface are cantilevered relative to the column;

wherein compressive forces generated in the product ejector are transmitted to the outer engaging surface; and a relief area formed in the engaging surface of the product ejector and generally aligned with the column.

15. The rotary cutting die of claim 14 wherein the inner end of the product ejector projects laterally from the column such that both the engaging surface and the inner end of the product ejector project laterally from the column and wherein the opposed sides of the product ejector form concaved areas between portions of the outer engaging surface and portions of the inner end.

16. The rotary cutting die of claim 14 wherein the product ejector includes concave-shaped sides.

17. The rotary cutting die of claim 14 wherein the product ejector forms a generally X-shaped configuration.

18. The rotary cutting die of claim 17 wherein opposed side edges of the product ejector assume >-shaped configurations.

19. The rotary cutting die of claim 14 including a reinforcing member secured to the engaging surface and extending over the relief area formed in the engaging surface.

20. A rotary cutting die adapted to be mounted on a rotary die cylinder for cutting corrugated board fed into a nip defined between the die cylinder and the surface of the anvil to produce a die cut product, the rotary cutting die comprising:

a curved die board configured to be mounted to the cylinder and including inner and outer surfaces;

one or more cutting blades mounted on the die board for cutting the corrugated board fed through the nip to produce the die cut product;

one or more product ejectors associated with the die board for engaging a portion of the die cut product passing through the nip and exerting a force on the die cut product which assists in separating the die cut product from the cutting die;

the product ejector comprising compressible material and including:

i. a generally central column;

ii. an outer cantilevered portion cantilevered off the column and wherein the cantilevered portion includes an engaging surface for engaging the die cut product;

iii. an inner base portion disposed on the end of the product ejector opposite the cantilevered portion, the inner base portion extending laterally from the column such that the width of the inner base portion is greater than a minimum width of the column; and iv. an open area lying outside the column and within the overall dimensions of the product ejector.

21. The rotary cutting die of claim 20 wherein the product ejector assumes a generally X-shaped configuration.

22. The rotary cutting die of claim 21 wherein the product ejector includes opposed sides and wherein each side assumes a generally >-shape.

23. The rotary cutting die of claim 20 wherein the product ejector includes a pair of opposed sides and wherein the opposed sides define the width of the column.

24. The rotary cutting die of claim 20 wherein the column extends between a pair of open areas where each open area is defined between the cantilevered portion and the laterally extending inner base portion of the product ejector.

25. The rotary cutting die of claim 20 wherein the product ejector includes opposed sides and wherein the opposed sides form a generally concave-shaped open area on opposite sides of the product ejector.

26. The rotary cutting die of claim 20 including a reinforcing member secured to the engaging surface of the cantilevered portion of the product ejector.

27. The rotary cutting die of claim 20 further including a reinforcing member secured to the engaging surface of the product ejector and wherein the reinforcing member comprises a thin sheet of mylar, plastic or fabric secured to the engaging surface.

28. A rotary cutting die adapted to be mounted on a rotary die cylinder for cutting corrugated board fed into a nip defined between the die cylinder and the surface of the anvil to produce a die cut product, the rotary cutting die comprising:

a curved die board configured to be mounted to the cylinder and including inner and outer surfaces;

one or more cutting blades mounted on the die board for cutting the corrugated board fed through the nip to produce the die cut product;

one or more product ejectors associated with the die board for engaging a portion of the die cut product passing through the nip and exerting a force on the die cut product which assists in separating the die cut product from the cutting die;

each product ejector comprising compressible material and including an inner portion, an intermediate portion and an outer portion which includes an engaging surface for engaging the die cut product passing through the nip;

wherein the intermediate portion of the product ejector is narrower than the outer portion of the product ejector and wherein the engaging surface includes a larger area than the cross-sectional area of the intermediate portion of the product ejector such that forces generated by the product ejector are distributed over the larger area of the engaging surface of the product ejector; and wherein the product ejector assumes a generally X-shaped configuration.

* * * * *